US009051719B2

(12) United States Patent
Li et al.

(10) Patent No.: US 9,051,719 B2
(45) Date of Patent: Jun. 9, 2015

(54) FIXING STRUCTURE OF FAUCET

(71) Applicant: Globe Union Industrial Corp., Taichung (TW)

(72) Inventors: Chunhung Li, Taichung (TW); Weimien Hsu, Taichung (TW); Yiping Lin, Taichung (TW); Yongjun Wu, Guangdong Pr (CN); Qiuyong Li, Guangdong Pr (CN); Wanhong Tan, Guangdong Pr (CN)

(73) Assignee: Globe Union Industrial Corp., Taichung (TW)

( * ) Notice: Subject to any disclaimer, the term of this patent is extended or adjusted under 35 U.S.C. 154(b) by 185 days.

(21) Appl. No.: 13/960,978

(22) Filed: Aug. 7, 2013

(65) Prior Publication Data

US 2013/0333109 A1 Dec. 19, 2013

Related U.S. Application Data

(63) Continuation-in-part of application No. 12/958,114, filed on Dec. 1, 2010, now Pat. No. 8,528,129.

(51) Int. Cl.
*E03C 1/042* (2006.01)
*E03C 1/04* (2006.01)

(52) U.S. Cl.
CPC ..... *E03C 1/0402* (2013.01); *E03C 2001/0416* (2013.01)

(58) Field of Classification Search
CPC ..... E03C 1/0401
USPC ..... 4/695
See application file for complete search history.

(56) References Cited

U.S. PATENT DOCUMENTS 5,535,776 A 7/1996 Kingman

*Primary Examiner* — Lori Baker
(74) *Attorney, Agent, or Firm* — Alan D. Kamrath; Kamrath IP Lawfirm, P.A.

(57) ABSTRACT

A fixing structure of a faucet is mounted on a sink countertop with an opening and contains a base including a supporting portion and an inserting portion. A supporting portion has an annular fence and an annular shoulder; the annular fence has a retaining recess; the annular shoulder has two longitudinally through holes and an opening. The inserting portion has a cylindrical fence and two stopping rods, and the cylindrical fence has a longitudinal channel; the annular shoulder has an annular abutting area. A locking assembly includes two positioning screws and two clamping blocks. A faucet includes a fitting tube, a sheath having a groove, a peripheral fence, and a threaded orifice. A controlling valve assembly is mounted on the fitting tube. A fastening bolt is screwed with the threaded orifice so as to retain with the retaining recess, thus fixing the faucet on the base.

16 Claims, 16 Drawing Sheets

FIXING STRUCTURE OF FAUCET

This application is a Continuation-in-Part of application Ser. No. 12/958,114, filed on Dec. 1, 2010.

BACKGROUND OF THE INVENTION

1. Field of the Invention

The present invention relates to a fixing structure of a faucet.

2. Description of the Prior Art

A conventional device for a top mounting of a faucet disclosed in U.S. Pat. No. 5,535,776 contains a fitting seat inserted into an opening of a support plate used in a kitchen equipped with a water tank, and the fitting seat includes a column with screws extending downward to the support plate and used to receive a body of the faucet, the column of the fitting seat includes a plastic pad, a spaced ring, and a metal retaining loop fitted thereon and screwed with a nut. A user applies a torque wrench to insert a screwing element into an orifice of a vertical wall of the fitting seat via a casing of the faucet to limit a relative movement between the faucet and the fitting seat, thus assembling the faucet.

However, many related components of such a conventional device for the top mounting of the faucet have to be installed below the water tank, limiting installing space and having a complicate installation.

The present invention has arisen to mitigate and/or obviate the afore-described disadvantages.

The present invention has arisen to mitigate and/or obviate the afore-described disadvantages.

SUMMARY OF THE INVENTION

The primary object of the present invention is to provide a fixing structure of a faucet and an operating method thereof that is capable of overcoming the shortcomings of the conventional fixing structure of a faucet.

To obtain the above objectives, a fixing structure of a faucet is mounted on a sink countertop with an opening and contains, a base, a locking assembly, a faucet, and a fastening bolt.

The base includes a supporting portion and an inserting portion connecting with the supporting portion;

the supporting portion has an annular fence and an annular shoulder coupling with an inner wall of the annular fence; the annular fence has a retaining recess defined on an outer wall thereof; the annular shoulder has two longitudinally through holes formed therein and an opening defined around an inner wall thereof;

the inserting portion has a cylindrical fence extending downwardly along an inner wall of the opening from a bottom end of the inner wall thereof and having two stopping rods connecting with an outer wall of the cylindrical fence, and the cylindrical fence has a longitudinal channel defined therein and communicating with the opening; the annular shoulder has an annular abutting area arranged on a bottom end thereof and around an upper end of the outer wall of the cylindrical fence, such that after the inserting portion of the base inserts into the opening of the sink countertop, the annular abutting area abuts against a top peripheral surface of the opening of the sink countertop so that the supporting portion of the base is supported and fixed on the sink countertop, wherein the two longitudinally through holes are formed adjacent to and spaced apart from an inner peripheral side of the annular abutting area.

The locking assembly includes two positioning screws rotatably inserting through the two longitudinally through holes of the base; and two clamping blocks are screwed with the two positioning screws, and when the two positioning screws are rotated, the two clamping blocks are rotated by the two stopping rods to move upwardly and then to retain a bottom peripheral surface of the opening of the sink countertop, thus fixing the base on the sink countertop.

The faucet includes a fitting tube; a sheath is connected with the fitting tube and has a groove defined therein and fitted on the base, the sheath also has a peripheral fence arranged around the groove and a threaded orifice defined on the peripheral fence; a controlling valve assembly mounted on a top end of the fitting tube and having bottom end connected with a water pipe set which pass through the fitting tube and the longitudinal channel of the base downwardly.

The fastening bolt is screwed with the threaded orifice of the sheath so as to retain with the retaining recess of the base, thus fixing the faucet on the base.

Thereby, the fixing structure of the faucet is fixed on and removed from the sink countertop easily and quickly.

Furthermore, the base and the faucet are coupled together quickly by means of the fixing protrusion of the base and the trench of the groove. In other words, after the sheath is fitted on the base, the fastening bolt is aligned with the retaining recess of the base precisely so as to further screw with the retaining recess rapidly.

The tilted bottom face of the retaining recess is applied to force the sheath to move downwardly so as to produce the longitudinal force when the distal end of the fastening bolt abuts against the tilted bottom face, and then the sheath forces the top peripheral surface of the sink countertop tightly, thus preventing water from leakage and fixing the sheath securely. In addition, the seal gasket is mounted on the bottom rim of the sheath and abuts against the top peripheral surface of the sink countertop closely, thereby increasing sealing effect.

The annular fence of the base has the biasing portion formed thereon and abutting against the receiving portion, wherein the biasing portion and the receiving portion have any one of a conical face and a tilted face so that when the fastening bolt abuts against the tilted bottom face, the sheath is forced to move downwardly by the longitudinal force, and then the sheath forces the top peripheral surface of the sink countertop tightly, thereby preventing water from leakage. Also, the tilted bottom face facilitates a sealing tightness between the sheath and the sink countertop.

It is to be noted that the first tunnel and the second tunnel are spaced apart so as to isolate the static water pipe set apart from the dynamic water pipe, such that when the hose is moved, the spray head is pulled and putted back to the original smoothly.

The fixing structure of the present invention is served to fix the faucet or the pull-out faucet on the sink countertop easily without interfering operation of the housing and the spray head.

The sheath is clamped between the fitting tube and the threaded sleeve easily by ways of the peripheral rib, the two defining notches, the peripheral bottom fringe, the two limiting blocks, and the threaded sleeve.

The sheath is connected with the fitting tube quickly and fixedly by using the annularly raised flange, the at least one first vertical slot, the at least one second vertical slot, the at least one engaging indention, the at least one sliding member, and the at least one resilient member without providing the threaded sleeve, thereby decreasing components and production coat.

DETAILED DESCRIPTION OF THE PREFERRED EMBODIMENTS

Figure 1:
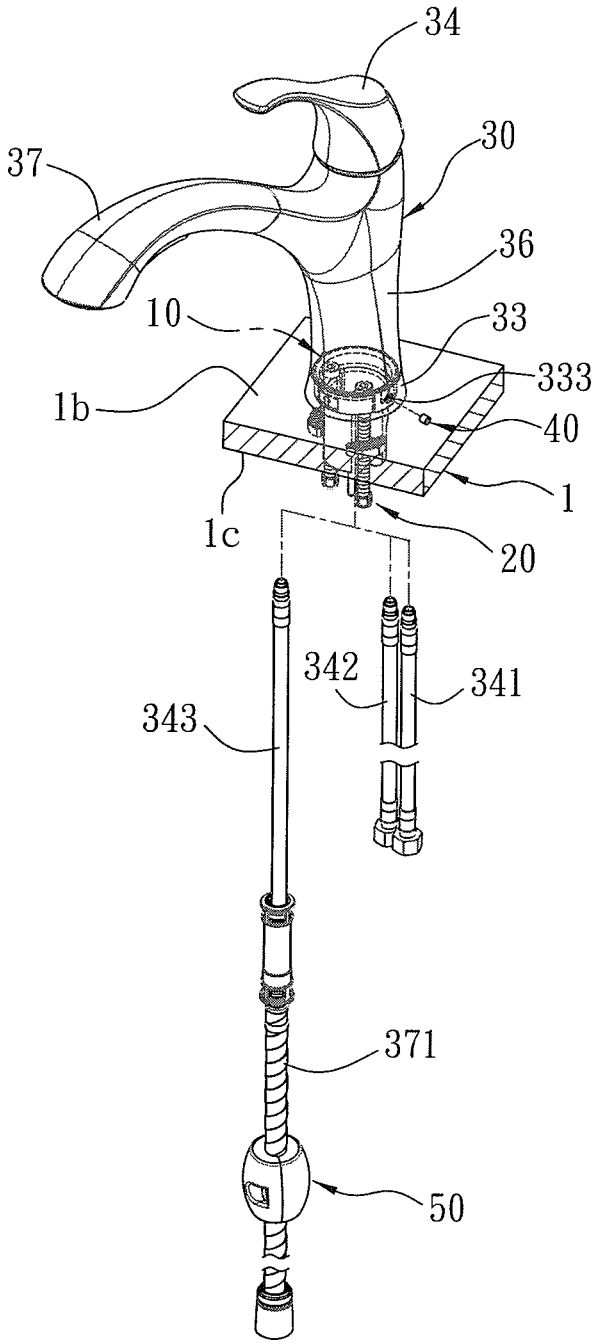
FIG. 1 is a perspective view showing the exploded components of a fixing structure of a faucet according to a first embodiment of the present invention.

Referring to FIGS. 1-4, a fixing structure of a faucet according to a first embodiment of the present invention is mounted on a sink countertop 1 with an opening 1*a*, and the sink countertop 1 is used in a kitchen cupboard equipped with a water tank, wherein a fixing structure of a faucet is fixed on the sink countertop 1 around the water tank.

The fixing structure of the faucet comprises a base 10, a locking assembly 20, a faucet 30, and a fastening bolt 40.

With reference to FIGS. 5-8, the base 10 includes a supporting portion 10*a* and an inserting portion 10*b* connecting with the supporting portion 10*a*.

Figure 9:
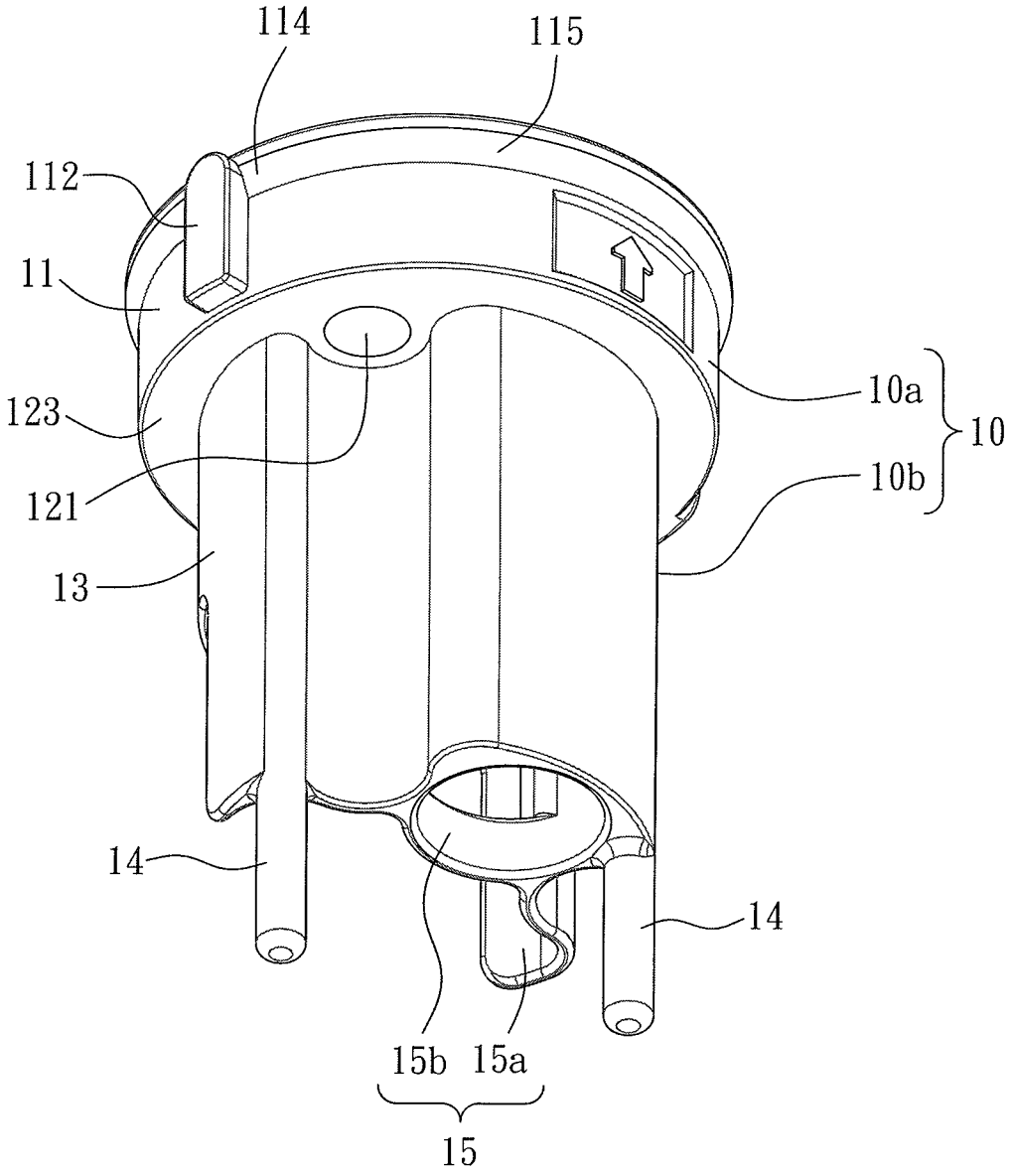
FIG. 9 is a perspective view showing the assembly of the base of the fixing structure of the faucet according to the first embodiment of the present invention.
Figure 10:
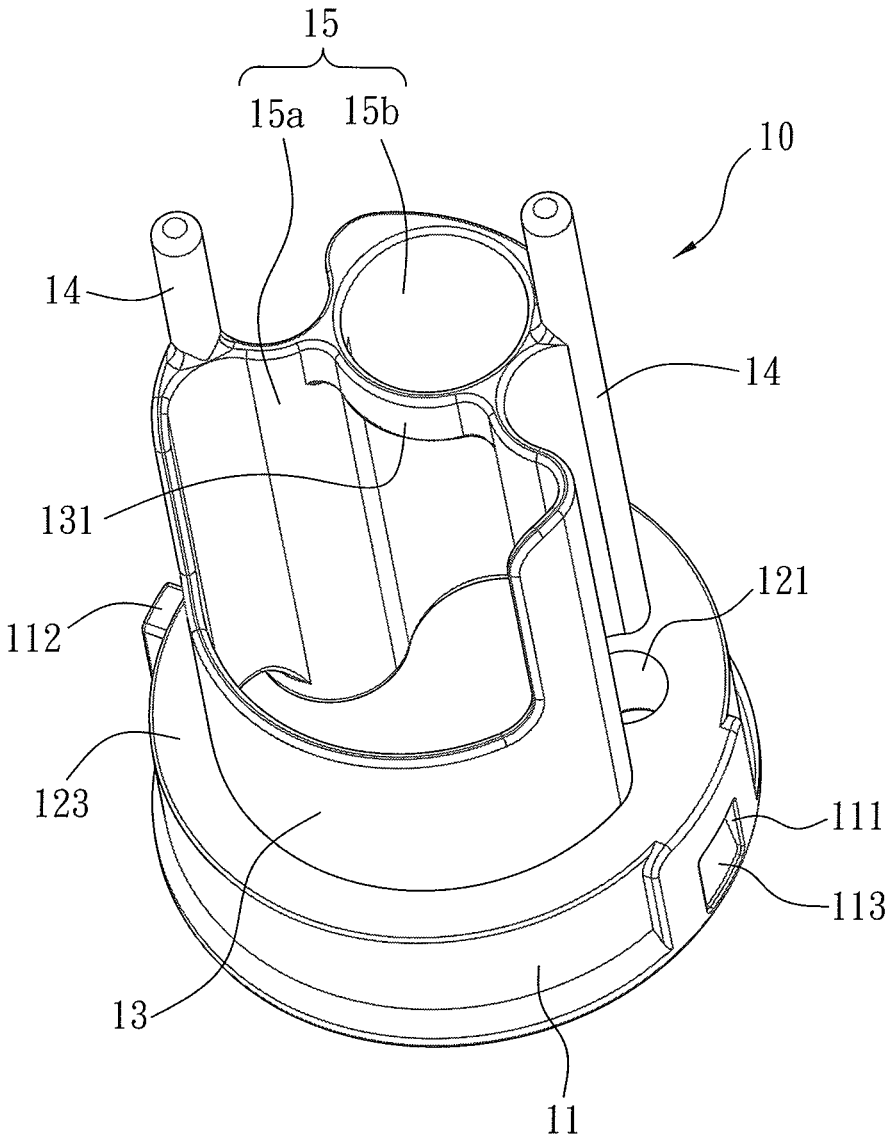
FIG. 10 is another perspective view showing the assembly of the base of the fixing structure of the faucet according to the first embodiment of the present invention.

As shown in FIGS. 9 and 10, the supporting portion 10*a* has an annular fence 11 and an annular shoulder 12 coupling with an inner wall of the annular fence 11, wherein the annular fence 11 has a retaining recess 111 defined on an outer wall thereof. The annular shoulder 12 has two longitudinally through holes 121 formed therein and an opening 122 defined around an inner wall thereof.

The inserting portion 10*b* has a cylindrical fence 13 extending downwardly along an inner wall of the opening 122 from a bottom end of the inner wall thereof and has two stopping rods 14 connecting with an outer wall of the cylindrical fence 13, and the cylindrical fence 13 has a longitudinal channel 15 defined therein and communicating with the opening 122.

The annular shoulder 12 has an annular abutting area 123 arranged on a bottom end thereof and around an upper end of the outer wall of the cylindrical fence 13, such that after the inserting portion 10*b* of the base 10 inserts into the opening 1*a* of the sink countertop 1, the annular abutting area 123 abuts against a top peripheral surface 1*b* of the opening 1*a* of the sink countertop 1 so that the supporting portion 10*a* of the base 10 is supported and fixed on the sink countertop 1. It is to be noted that the two longitudinally through holes 121 are formed adjacent to and spaced apart from an inner peripheral side of the annular abutting area 123.

The locking assembly 20, as shown in FIGS. 5-8, includes two positioning screws 21 and two clamping blocks 22.

The two positioning screws 21 rotatably insert through the two longitudinally through holes 121 of the base 10. Since the two longitudinally through holes 121 are formed adjacent to and spaced apart from the inner peripheral side of the annular abutting area 123, the two positioning screws 21 insert through the two longitudinally through holes 121 smoothly and do not interfere with the opening 1*a* of the sink countertop 1.

The two clamping blocks 22 are screwed with the two positioning screws 21, and when the two positioning screws 21 are rotated, the two clamping blocks 22 are rotated by the two stopping rods 14 to move upwardly and then retain a bottom peripheral surface 1*c* of the opening 1*a* of the sink countertop 1, thus fixing the base 10 on the sink countertop 1.

Each positioning screw 21 has a bottom end for screwing a positioning sleeve 23, such that each clamping block 22 is stopped moving downwardly and removing from each positioning screw 21.

The faucet 30, as illustrated in FIGS. 1-4, includes a fitting tube 31, a threaded sleeve 32, a sheath 33, a controlling valve assembly 34, a cap 35, a housing 36, and a spray head 37.

Figure 11:
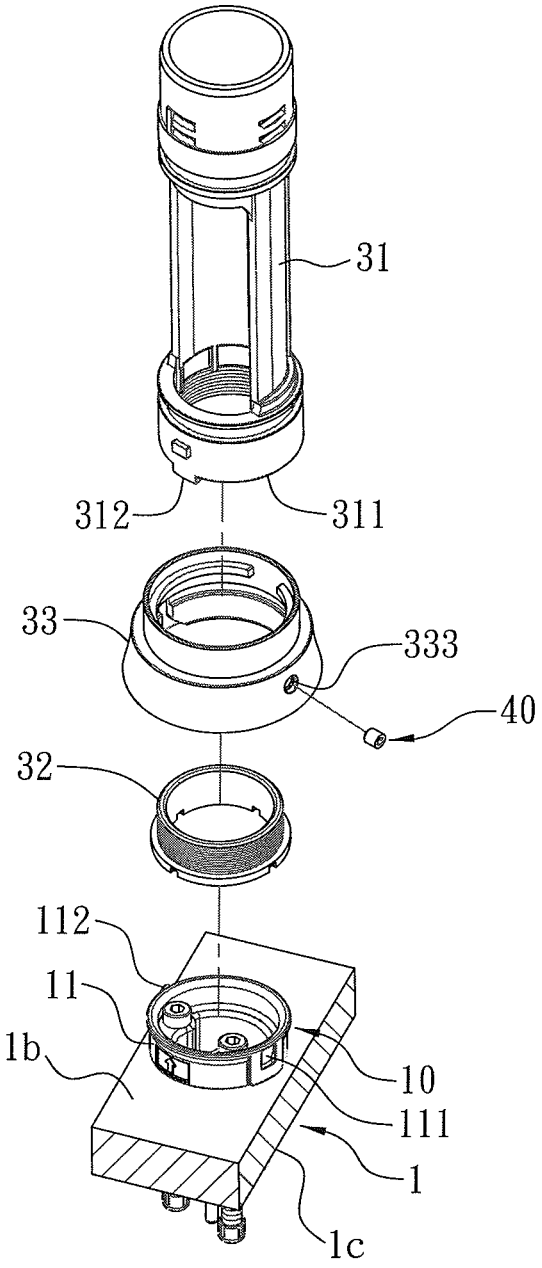
FIG. 11 is another perspective view showing the exploded components of the fixing structure of the faucet according to the first embodiment of the present invention.

As shown in FIG. 11, the threaded sleeve 32 is screwed with a bottom end of the fitting tube 31.

Referring further to FIGS. 11-14, the sheath 33 is clamped between the fitting tube 31 and the threaded sleeve 32, and the sheath 33 has a groove 331 defined therein and is fitted on the base 10, the sheath 33 also has a peripheral fence 332 arranged around the groove 331 and a threaded orifice 333 defined on the peripheral fence 332.

The controlling valve assembly 34 is mounted on a top end of the fitting tube 31 and has a bottom end connected with a water pipe set. The water pipe set has a cold-water inlet pipe 341, a hot-water inlet pipe 342, and a mixing outlet pipe 343 which pass through the fitting tube 31, the threaded sleeve 32, the opening 122 and the longitudinal channel 15 of the base 10 downwardly.

The cap 35 is fitted on the top end of the fitting tube 31.

The housing 36 is rotatably fitted on an outer wall of the fitting tube 31 and is limited between the cap 35 and the sheath 33.

The spray head 37 is positioned on the housing 36 and has a hose 371 passing through the longitudinal channel 15 of the base 10 so as to couple with the mixing outlet pipe 343, the spray head 37 is pulled outwardly and putted back to an original position.

With reference to FIGS. 11-14, the groove 331 of the sheath 33 has a trench 334 defined on an inner wall thereof and extending to a bottom rim of the sheath 33. The annular fence 11 of the base 10 has a fixing protrusion 112 formed around the outer wall thereof and retained in the trench 334, such that the sheath 33 and the base 10 are positioned quickly by ways of the threaded orifice 333 and the retaining recess 111.

With reference to FIGS. 11-14, the fitting tube 31 further has a peripheral bottom fringe 311 defined therearound and two limiting blocks 312 extending outwardly from the peripheral bottom fringe 311, the groove 331 of the sheath 33 has a peripheral rib 335 arranged adjacent to an upper side of the inner wall thereof and clamped between the peripheral bottom fringe 311 of the fitting tube 31 and the threaded sleeve 32, the peripheral rib 335 has two defining notches 336 formed thereon so as to retain with the two limiting blocks 312, hence the fitting tube 31 is limited to rotate relative to the sheath 33, and the threaded sleeve 32 and the fitting tube 31 are screwed easily.

Figure 14:
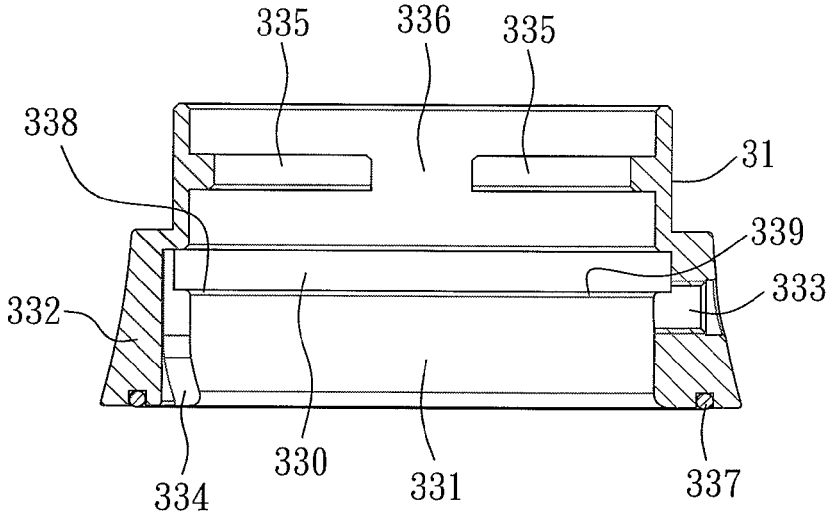
FIG. 14 is a cross sectional view taken along the line 3-3 of FIG. 13.

The fastening bolt 40, as shown in FIGS. 11 and 14, is screwed with the threaded orifice 333 of the sheath 33 so as to retain with the retaining recess 111 of the base 10, thus fixing the faucet 30 on the base 10.

Figure 4:
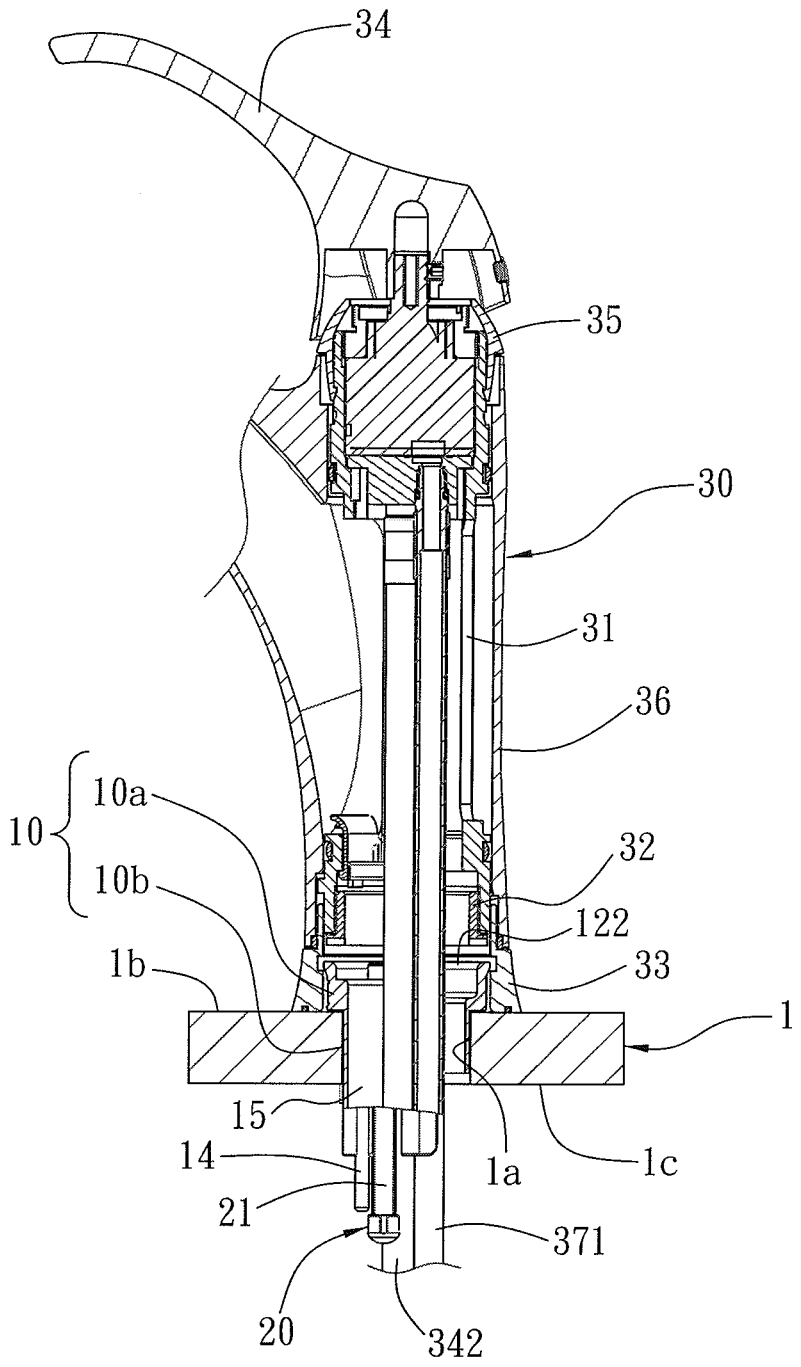
FIG. 4 is an amplified cross sectional view of a part of FIG. 3.

The cylindrical fence 13 of the base 10 has an isolation cliff 131 defined proximate to a lower side of an inner wall thereof as illustrated in FIGS. 4, 9 and 11 so as to space apart a first tunnel 15*a* and a second tunnel 15*b* smaller than the first tunnel 15*a*. The first tunnel 15*a* is served to insert through the cold-water inlet pipe 341, the hot-water inlet pipe 342, and the mixing outlet pipe 343; the second tunnel 15*b* is used for inserting through the hose 371. It is to be noted that the cold-water inlet pipe 341, the hot-water inlet pipe 342, and the mixing outlet pipe 343 are a static water pipe set, and the hose 371 is a dynamic water pipe. The isolation cliff 131 is used to isolate the static water pipe set apart from the dynamic water pipe, such that when the dynamic water pipe set is moved, it is not interfered by the static water pipe set. Accordingly, the spray head 37 is pulled and putted back to the original position smoothly.

Figure 5:
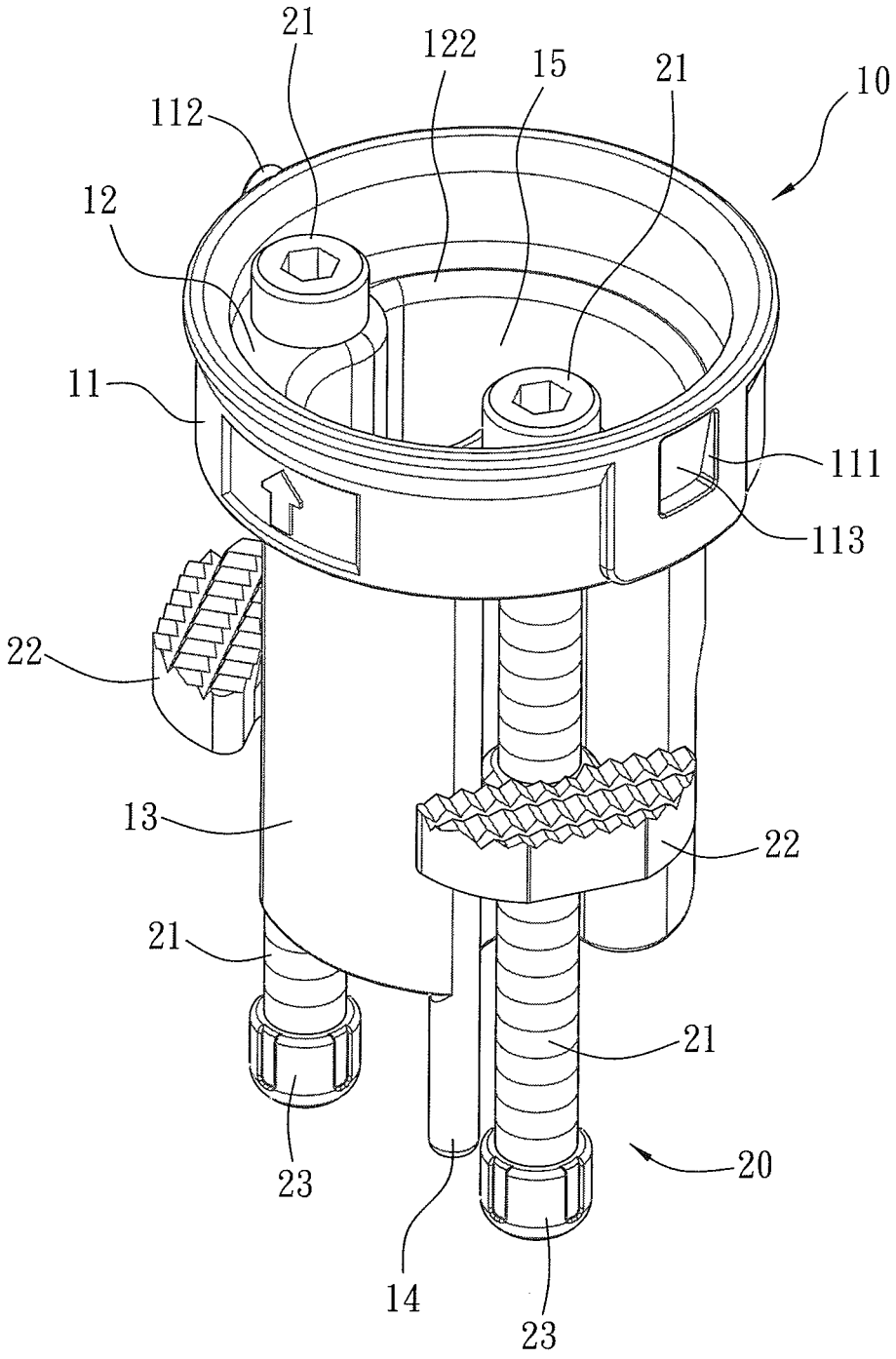
FIG. 5 is a perspective view showing the assembly of a base and a locking assembly of the fixing structure of the faucet according to the first embodiment of the present invention.
Figure 6:
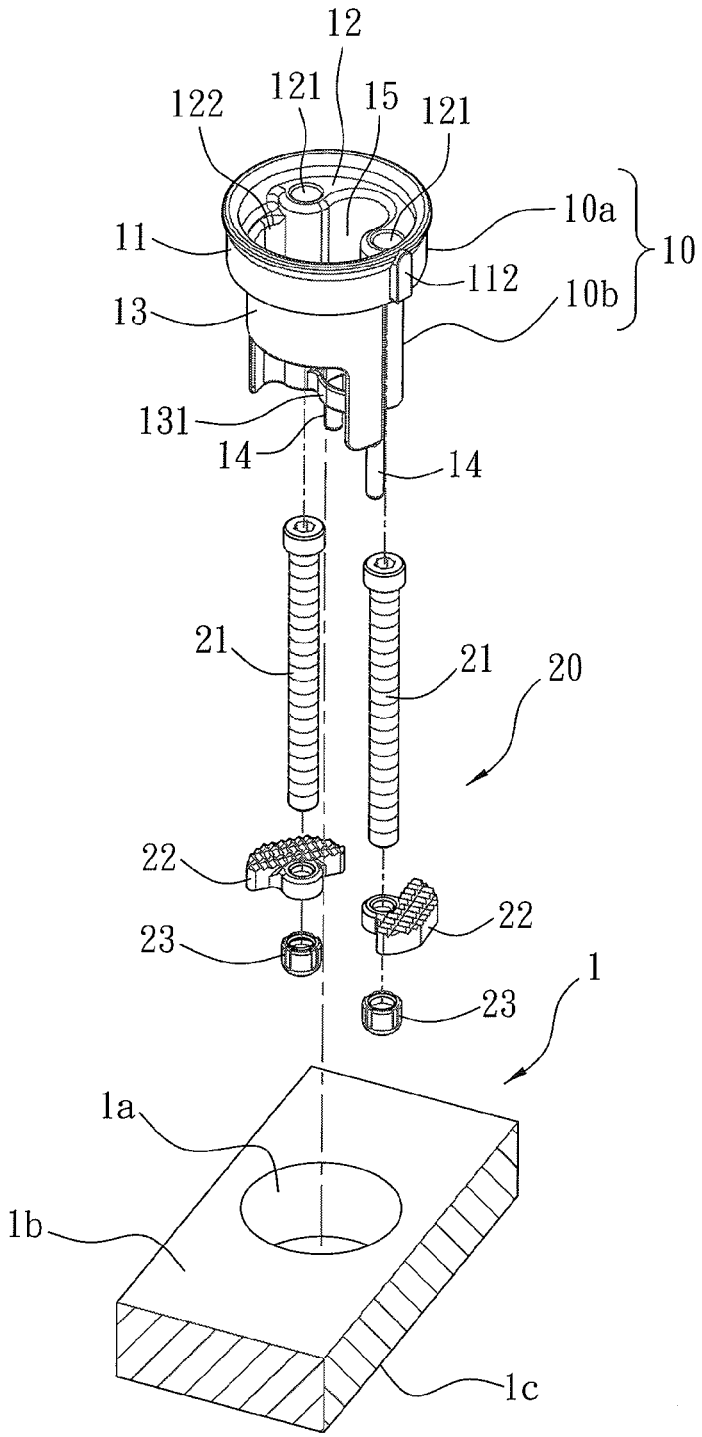
FIG. 6 is a perspective view showing the exploded components of the base, the locking assembly, and a sink countertop of the fixing structure of the faucet according to the first embodiment of the present invention.
Figure 7:
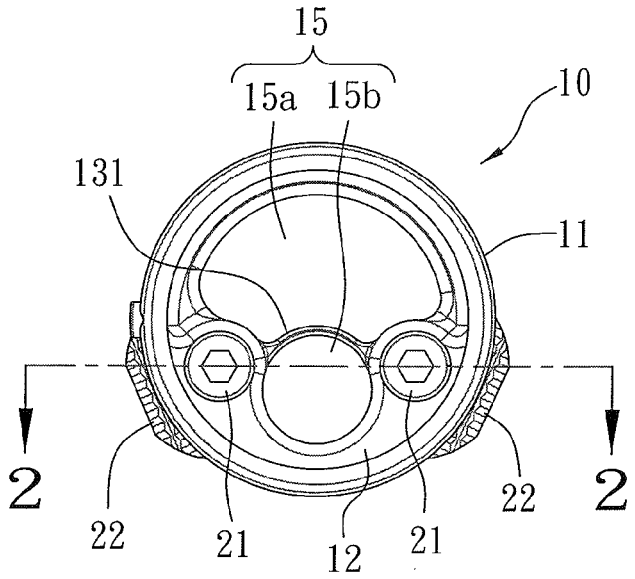
FIG. 7 is a plan view showing the assembly of the base and the locking assembly of the fixing structure of the faucet according to the first embodiment of the present invention.
Figure 15:
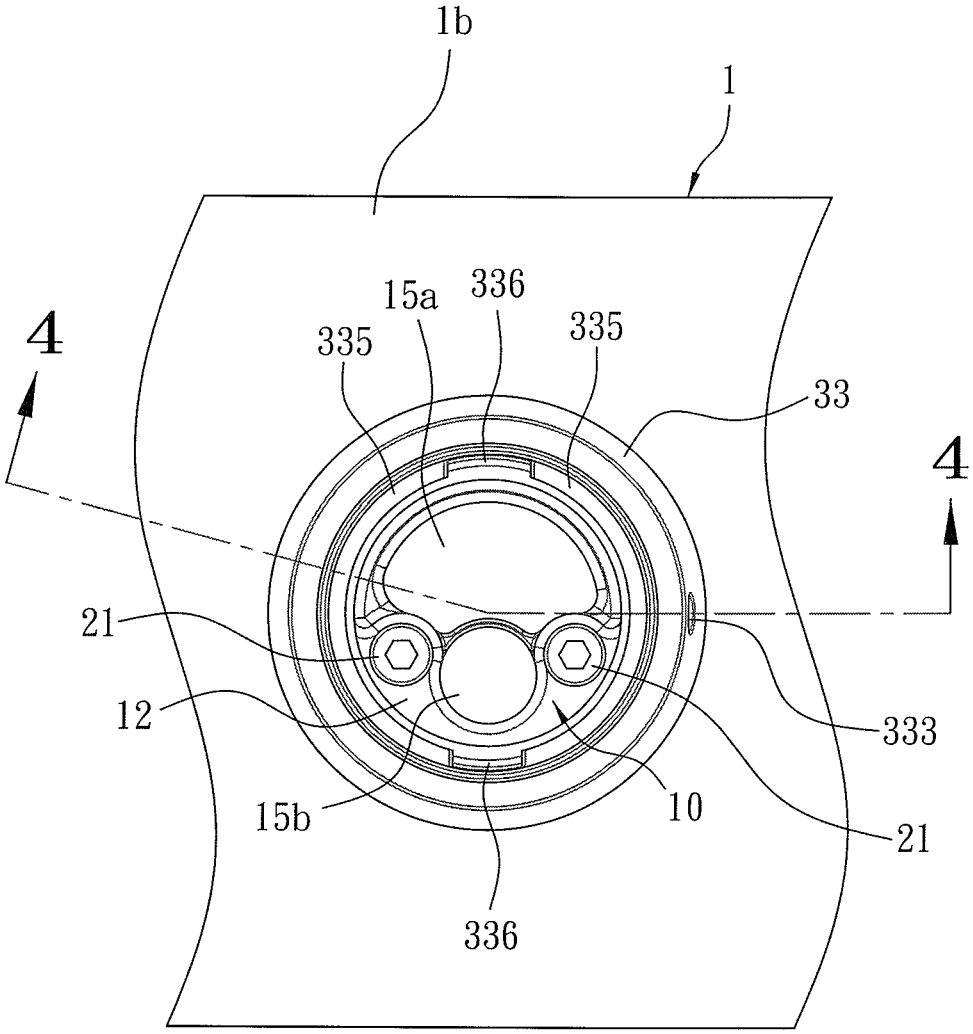
FIG. 15 is a plan view showing the operation of the fixing structure of the faucet according to the first embodiment of the present invention.
Figure 16:
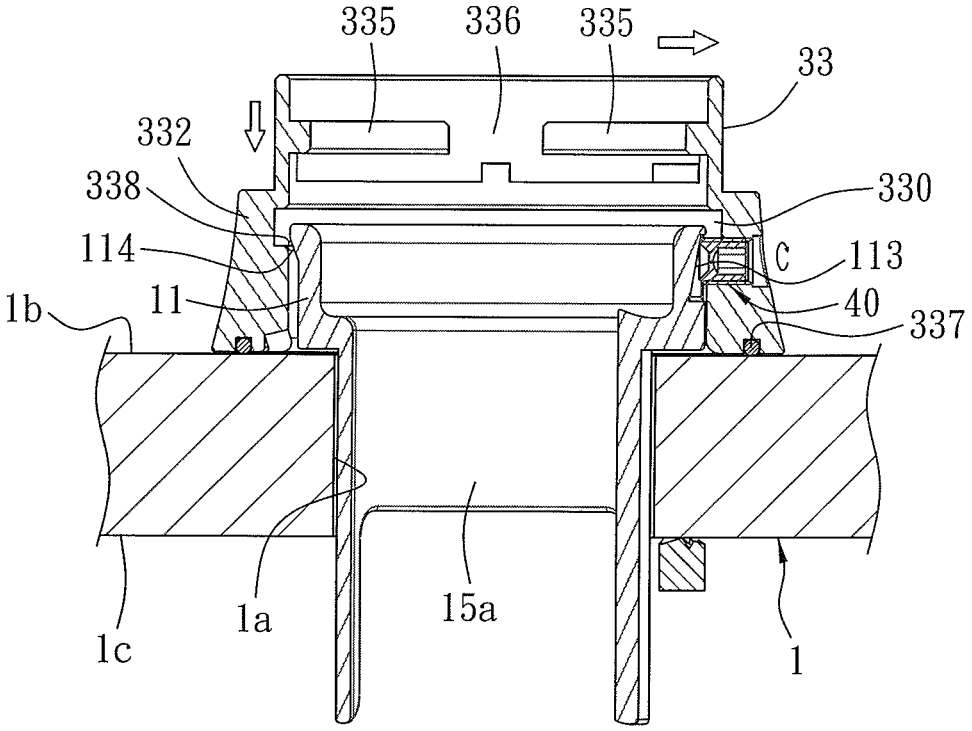
FIG. 16 is a cross sectional view taken along the line 4-4 of FIG. 15.
Figure 17:
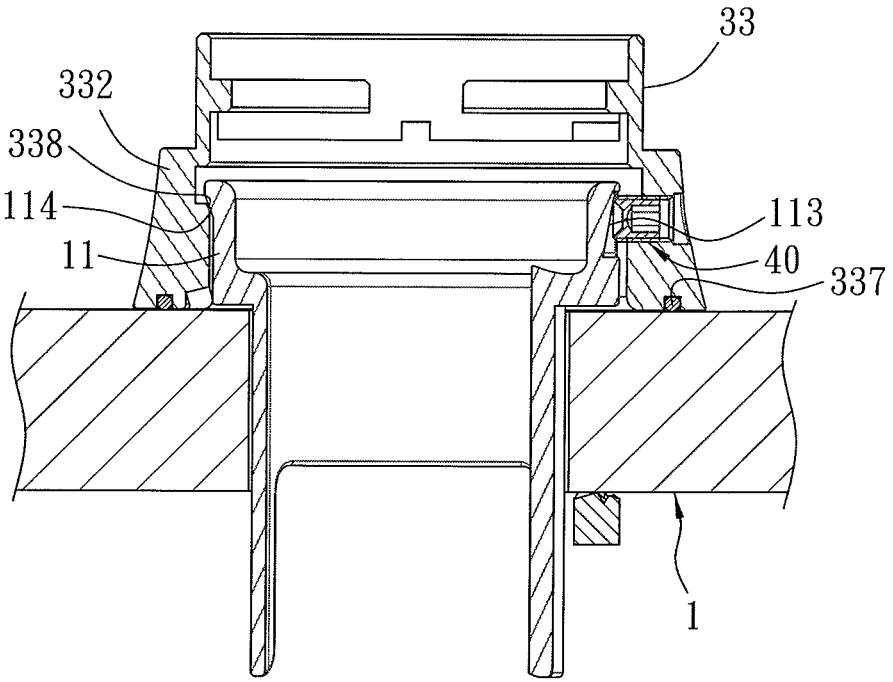
FIG. 17 is a cross sectional view showing the operation of a fastening bolt of the fixing structure of the faucet according to the first embodiment of the present invention.

The retaining recess 111 of the base 10 has a tilted bottom face 113 as shown in FIGS. 5 and 16, hence when screwing the fastening bolt 40, a distal end of the fastening bolt 40 abuts against the tilted bottom face 113 so that the base 10 and the sheath 33 produce a longitudinal force, and since the base 10 is fixed on the sink countertop 1, the longitudinal force moves the sheath 33 downwardly so that the bottom rim of the sheath 33 contacts with the top peripheral surface 1*b* of the sink countertop 1 tightly as shown in FIG. 15 to FIG. 17, thus preventing water from leakage between the sheath 33 and the sink countertop 1. The sheath 33 has a seal gasket 337 mounted on the bottom rim thereof and abutting against the top peripheral surface 1*b* of the sink countertop 1 closely, thus increasing sealing effect.

Figure 8:
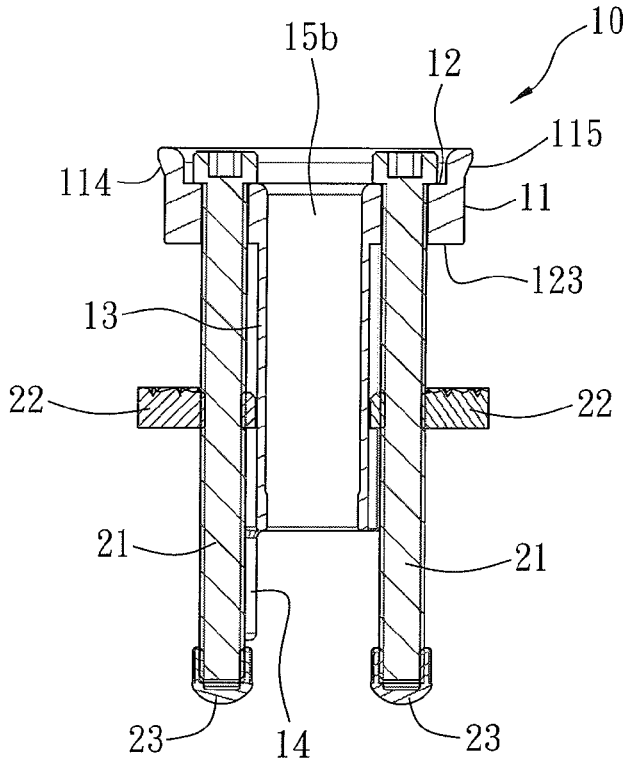
FIG. 8 is a cross sectional view taken along the line 2-2 of FIG. 7.

With reference to FIGS. 8 and 9, the annular fence 11 of the base 10 also has a biasing portion 114 formed thereon; wherein the annular fence 11 of the base 10 further has a circular flange 115 arranged on the biasing portion 114 as shown in FIGS. 15-17.

Figure 12:
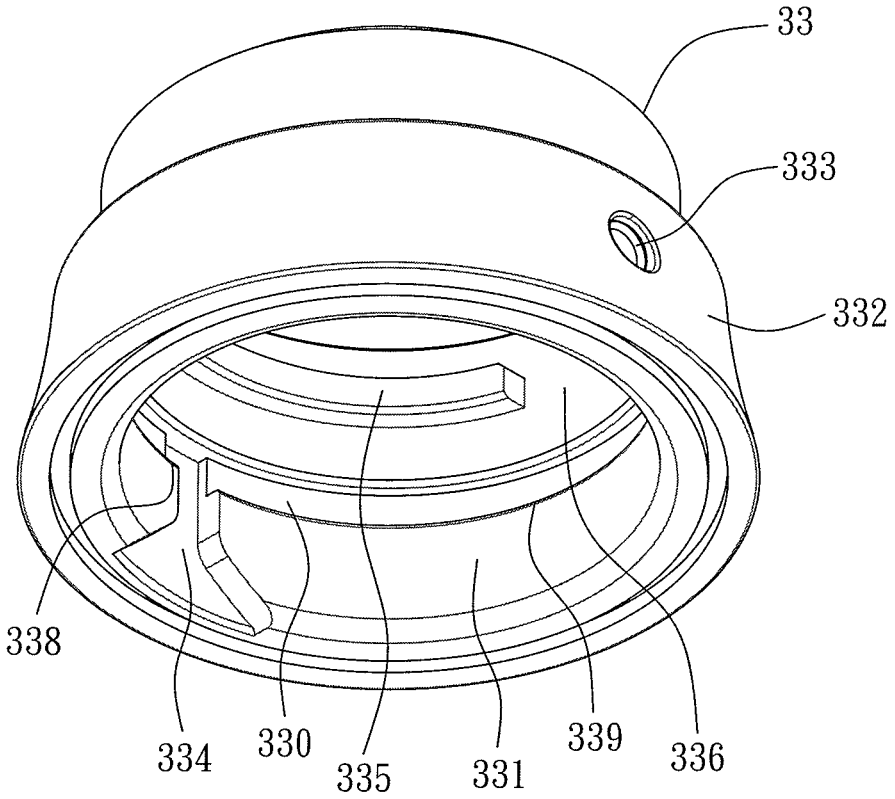
FIG. 12 is a perspective view showing the assembly of a sheath of the fixing structure of the faucet according to the first embodiment of the present invention.
Figure 13:
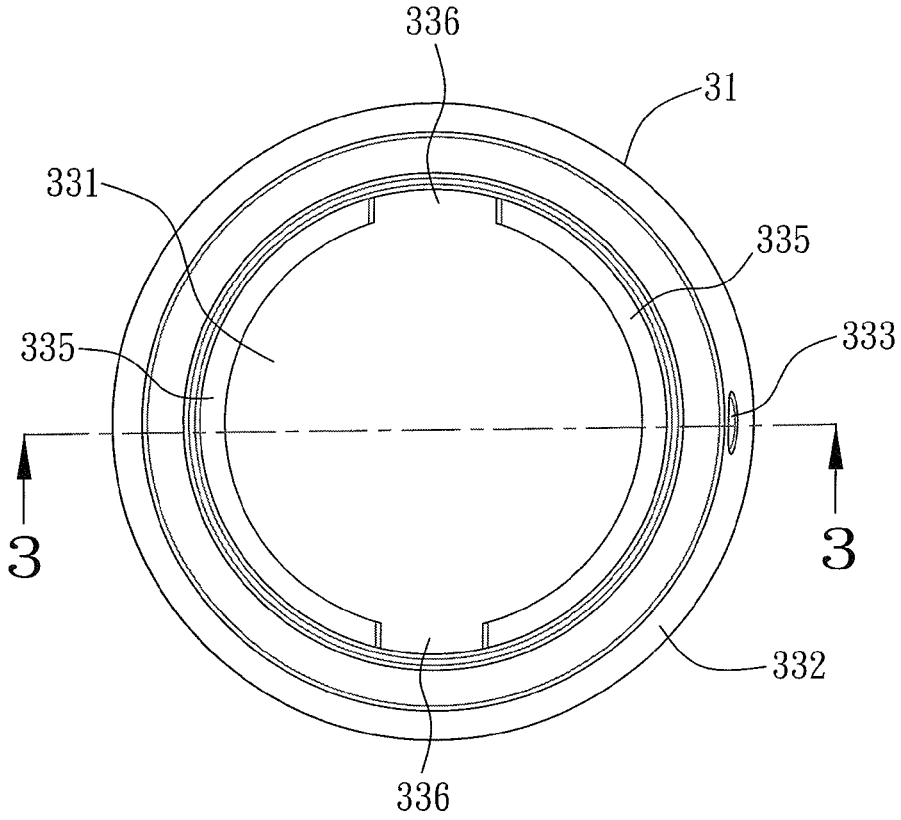
FIG. 13 is a plan view showing the assembly of a sheath of the fixing structure of the faucet according to the first embodiment of the present invention.

Referring to FIGS. 12 and 14, the groove 331 has a receiving portion 331 defined on the inner wall thereof and forced by the biasing portion 114; wherein the groove 331 also has a circular trough 330 formed on the inner wall thereof, and the circular trough 330 has a circular lip 339 arranged thereon, wherein the receiving portion 338 is comprised of the circular lip 339.

The biasing portion 114 has a conical face, and the receiving portion 338 has an arcuate guiding face, such that as screwing the fastening bolt 40, the distal end of the fastening bolt 40 is biased against the tilted bottom face 113 and generates a longitudinal force so as to move the sheath 33 downwardly, hence the bottom rim of the sheath 33 contacts with the top peripheral surface 1*b* of the sink countertop 1 as illustrated in FIG. 17. In this embodiment, the seal gasket 337 of the sheath 33 contacts with the top peripheral surface 1*b* tightly so as to prevent water from leakage.

It is to be noted that the biasing portion 114 can be also a tilted face, and the receiving portion 338 can be also a conical face or a tilted face so that when the biasing portion 114 and the receiving portion 338 abut against each other, the sheath 33 is forced to move downwardly, thereby preventing water from leakage.

Figure 2:
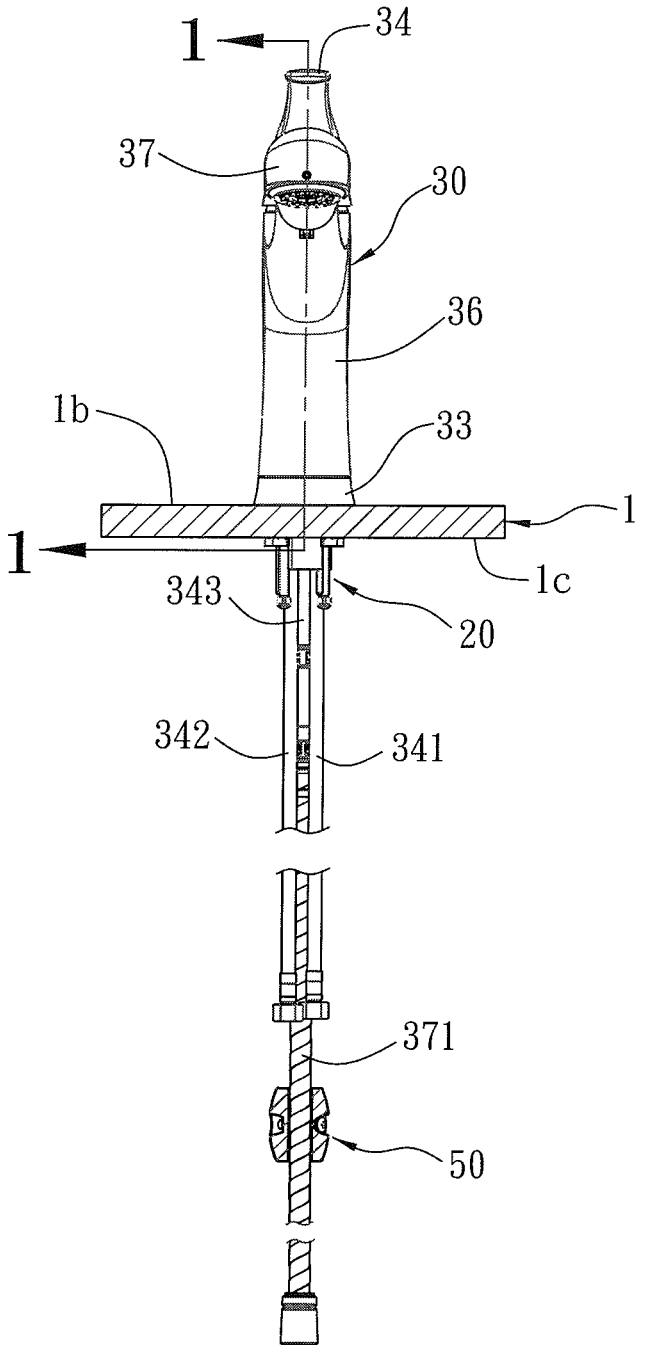
FIG. 2 is a cross sectional view showing the assembly of the fixing structure of the faucet according to the first embodiment of the present invention.
Figure 3:
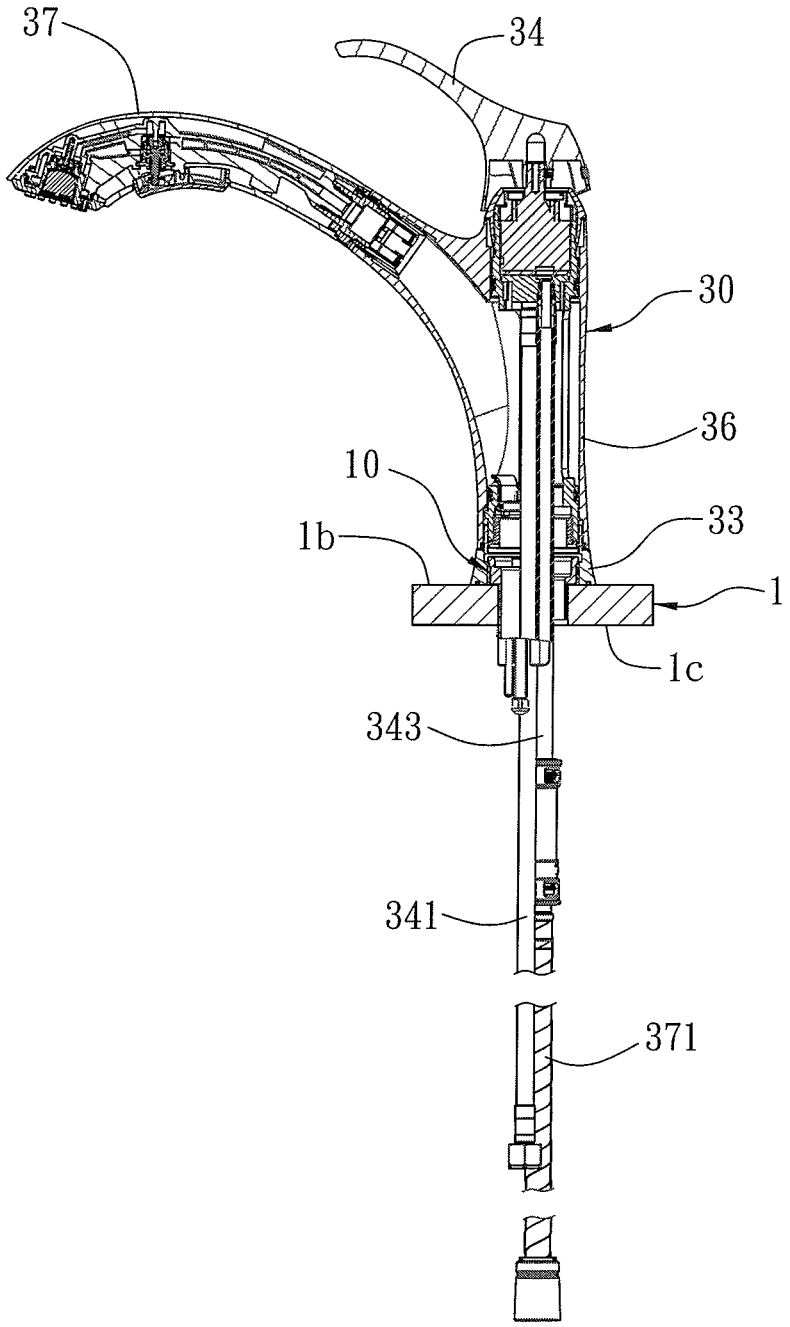
FIG. 3 is a partially cross sectional view taken along the line 1-1 of FIG. 2.

As shown in FIGS. 1 to 3, the fixing structure of the faucet also comprises a hammer 50 disposed on the hose 371 so as to drive the spray head 37 to move outwardly and back to the original position.

An operating method of the fixing structure of the faucet includes steps of:

a. Fixing the base 10 on the sink countertop 1. Before fixing the base 10 on the sink countertop 1, the locking assembly 20 is positioned on the base 10, and each clamping block 22 is adjusted in an angle in a direction so that the annular shoulder 12 of the base 10, the two clamping blocks 22, and the two positioning screws 21 are inserted to a lower side of the sink countertop 1 from the opening 1*a* of the sink countertop 1. Thereafter, a tool is used to rotate each positioning screw 21 so that each clamping block 22 is limited by each stopping rod 14 to rotate upwardly and then retains around the opening 1*a* of the sink countertop 1, hence the base 10 is fixed on the sink countertop 1 by means of the locking assembly 20.

b. Mounting the faucet 30 on the base 10. Before mounting the faucet 30 on the base 10, the threaded sleeve 32 and the fitting tube 31 are screwed together so that the cold-water inlet pipe 341, the hot-water inlet pipe 342, the mixing outlet pipe 343, and the hose 371 are extended out of the first tunnel 15*a* and the second tunnel 15*b* of the base 10. Then, the groove 331 of the sheath 33 is aligned with the annular fence 11 of the base 10, the trench 334 of the groove 331 is aligned and retained with the fixing protrusion 112 of the annular fence 11. The fastening bolt 40 is screwed tightly so as to abut against the retaining recess 111 of the base 10. Finally, the hose 371 is connected with the mixing outlet pipe 343, and the hammer 50 is adjusted, thus mounting the faucet 30 on the base 10. As removing the faucet 30, the mixing outlet pipe 343 is removed from the hose 371, and the fastening bolt 40 is unscrewed so as to remove the faucet 30 from the base 10.

In this embodiment, the faucet is a pull-out faucet. It is to be noted that the faucet can be also a non pull-out faucet which does not include the spray head, the hose, and the hammer of the pull-out faucet. And a controlling valve assembly of the non pull-out faucet only includes the cold-water inlet pipe and the hot-water inlet pipe of the pull-out faucet. In addition, the mixing outlet pipe is disposed in the housing 36 and is coupled with an outlet of the housing 36.

With reference to FIG. 11, the sheath 33 can be connected with the fitting tube 31 by other components.

Figure 18:
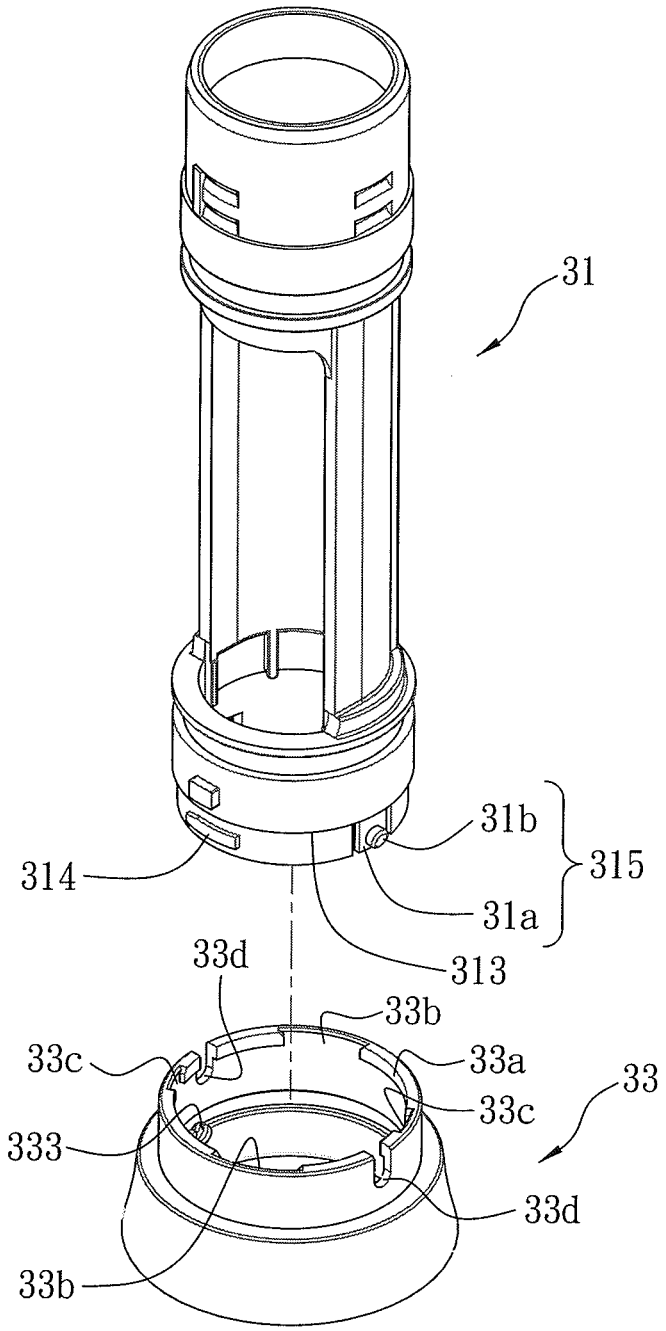
FIG. 18 is a perspective view showing the exploded components of a fixing structure of a faucet according to a second embodiment of the present invention.
Figure 19:
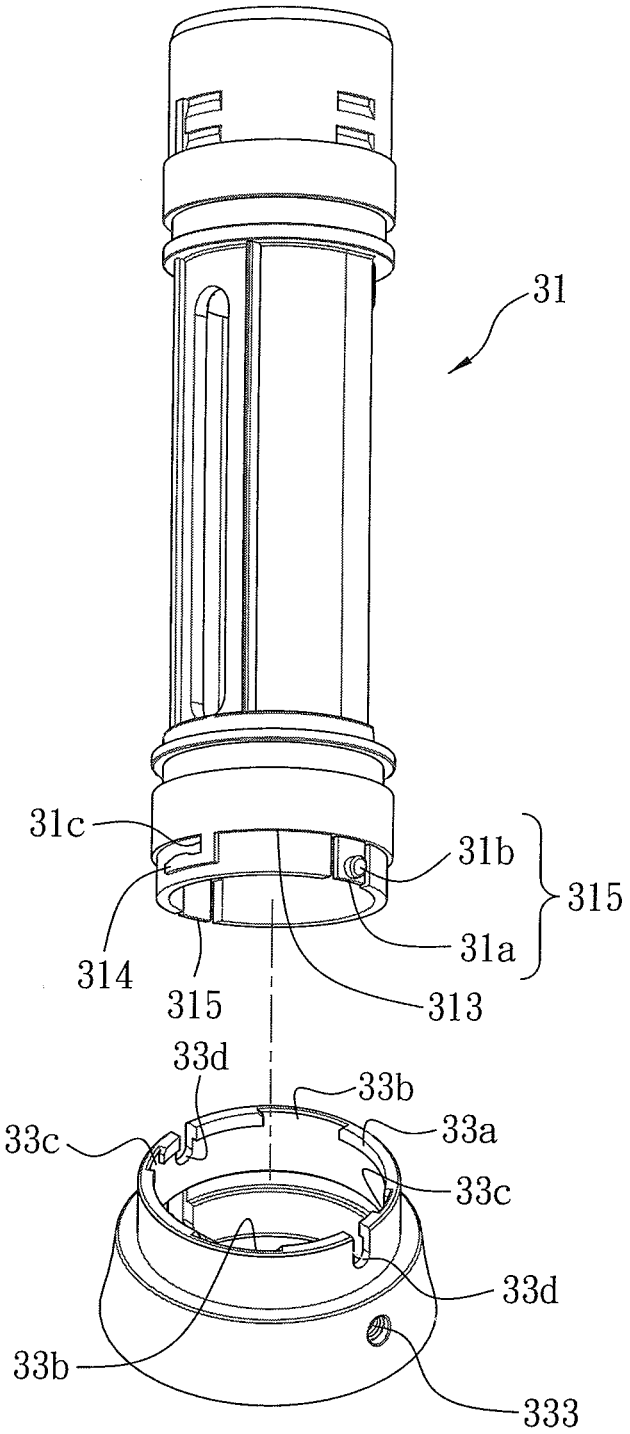
FIG. 19 is another perspective view showing the exploded components of the fixing structure of the faucet according to the second embodiment of the present invention.

For example, as shown in FIGS. 18 and 19, a groove 331 of a sheath 33 of a second embodiment has an annularly raised flange 33*a* extending outwardly from the inner wall thereof, and the annularly raised flange 33*a* has at least two cutouts for defining at least one first vertical slot 33*b* and at least one second vertical slot 33*c*; the groove 331 of the sheath 33 further has at least one engaging indention 33*d* defined on a top rim thereof. A fitting tube 31 of the second embodiment has a stepped fence 313 formed on an outer wall thereof adjacent to a bottom end of the fitting tube 31 so as to contact with a top wall of the annularly raised flange 33*a* of the sheath 33, and the stepped fence 313 has at least one sliding member 314 formed on an outer wall of a lower side thereof and at least one resilient member 315; the at least one sliding member 314 is slid into the at least one first vertical slot 33*b* of the sheath 33, and the at least one resilient member 315 is slid into the at least one second vertical slot 33*c* of the sheath 33. When the fitting tube 31 is rotated toward a predetermined direction, the at least one sliding member 314 engages with a bottom wall of the annularly raised flange 33*a* of the sheath 33 so as to limit the fitting tube 31 to remove upwardly, and the at least one resilient member 315 slides into and retains with the at least one engaging indention 33*d*, thus limiting the fitting tube 31 rotation circumferentially.

In this embodiment, each of the at least one resilient member 315 has an elastic wing portion 31*a* and a pillar 31*b* extending outwardly from an outer wall of the elastic wing portion 31*a* so as to be fixed in each of the at least one engaging indention 33*d*.

Preferably, the sheath 33 has two symmetrical first vertical slots 33*b*, two symmetrical second vertical slots 33*c*, and two engaging indentions 33*d*. The fitting tube 31 has two sliding members 314 and two resilient members 315, and the at least one sliding member 314 has a longitudinal cliff 31*c* formed thereon and retaining with one of the at least one first vertical slot 33*b* as the fitting tube 31 rotates toward a predetermined direction, such that each resilient member 315 engages with each engaging indention 33*d*.

Thereby, the fixing structure of the faucet is fixed on and removed from the sink countertop 1 easily and quickly.

Furthermore, the base 10 and the faucet 30 are coupled together quickly by means of the fixing protrusion 112 of the base 10 and the trench 334 of the groove 331. In other words, after the sheath 33 is fitted on the base 10, the fastening bolt 40 is aligned with the retaining recess 111 of the base 10 precisely so as to further screw with the retaining recess 111 rapidly.

The tilted bottom face 113 of the retaining recess 111 is applied to force the sheath 33 to move downwardly so as to produce the longitudinal force when the distal end of the fastening bolt 40 abuts against the tilted bottom face 113, and then the sheath 33 forces the top peripheral surface 1*b* of the sink countertop 1 tightly, thus preventing water from leakage and fixing the sheath 33 securely. In addition, the seal gasket 337 is mounted on the bottom rim of the sheath 33 and abuts against the top peripheral surface 1*b* of the sink countertop 1 closely, thereby increasing sealing effect.

The annular fence 11 of the base 10 has the biasing portion 114 formed thereon and abutting against the receiving portion 338, wherein the biasing portion 114 and the receiving portion 338 have any one of a conical face and a tilted face so that when the fastening bolt 40 abuts against the tilted bottom face 113, the sheath 33 is forced to move downwardly by the longitudinal force, and then the sheath 33 forces the top peripheral surface 1*b* of the sink countertop 1 tightly, thereby preventing water from leakage. Also, the tilted bottom face 113 facilitates a sealing tightness between the sheath 33 and the sink countertop 1.

It is to be noted that the first tunnel 15*a* and the second tunnel 15*b* are spaced apart so as to isolate the static water pipe set apart from the dynamic water pipe, such that when the hose 371 is moved, the spray head 37 is pulled and putted back to the original smoothly.

The fixing structure of the present invention is served to fix the faucet 30 or the pull-out faucet 30 on the sink countertop 1 easily without interfering operation of the housing 36 and the spray head 37.

The sheath 33 is clamped between the fitting tube 31 and the threaded sleeve 32 easily by ways of the peripheral rib 335, the two defining notches 336, the peripheral bottom fringe 311, the two limiting blocks 312, and the threaded sleeve 32.

The sheath 33 is connected with the fitting tube 31 quickly and fixedly by using the annularly raised flange 33*a*, the at least one first vertical slot 33*b*, the at least one second vertical slot 33*c*, the at least one engaging indention 33*d*, the at least one sliding member 314, and the at least one resilient member 315 without providing the threaded sleeve 32, thereby decreasing components and production coat.

While we have shown and described various embodiments in accordance with the present invention, it is clear to those skilled in the art that further embodiments may be made without departing from the scope of the present invention.

What is claimed is:

1. A fixing structure of a faucet being mounted on a sink countertop with an opening and comprising:

a base including a supporting portion and an inserting portion connecting with the supporting portion;

the supporting portion having an annular fence and an annular shoulder coupling with an inner wall of the annular fence; the annular fence having a retaining recess defined on an outer wall thereof; the annular shoulder having two longitudinally through holes formed therein and an opening defined around an inner wall thereof;

the inserting portion having a cylindrical fence extending downwardly along an inner wall of the opening from a bottom end of the inner wall thereof and having two stopping rods connecting with an outer wall of the cylindrical fence, and the cylindrical fence having a longitudinal channel defined therein and communicating with the opening; the annular shoulder having an annular abutting area arranged on a bottom end thereof and around an upper end of the outer wall of the cylindrical fence, such that after the inserting portion of the base inserts into the opening of the sink countertop, the annular abutting area abuts against a top peripheral surface of the opening of the sink countertop so that the supporting portion of the base is supported and fixed on the sink countertop, wherein the two longitudinally through holes are formed adjacent to and spaced apart from an inner peripheral side of the annular abutting area;

a locking assembly including two positioning screws rotatably inserting through the two longitudinally through holes of the base; and two clamping blocks screwed with the two positioning screws, and when the two positioning screws are rotated, the two clamping blocks are rotated by the two stopping rods to move upwardly and then to retain a bottom peripheral surface of the opening of the sink countertop, thus fixing the base on the sink countertop;

a faucet including a fitting tube; a sheath connected with the fitting tube and having a groove defined therein and fitted on the base, the sheath also having a peripheral fence arranged around the groove and a threaded orifice defined on the peripheral fence; a controlling valve assembly mounted on a top end of the fitting tube and having a bottom end connected with a water pipe set which pass through the fitting tube and the longitudinal channel of the base downwardly;

a fastening bolt screwed with the threaded orifice of the sheath so as to retain with the retaining recess of the base, thus fixing the faucet on the base.

2. The fixing structure of the faucet as claimed in claim 1, wherein the faucet further includes a housing rotatably fitted on an outer wall of the fitting tube; a spray head positioned on the housing and having a hose passing through the longitudinal channel of the base; the water pipe set has a cold-water inlet pipe, a hot-water inlet pipe, and a mixing outlet pipe which connects with the hose; the spray head is pulled outwardly and putted back to an original position.

3. The fixing structure of the faucet as claimed in claim 2, wherein the cylindrical fence of the base has an isolation cliff defined proximate to a lower side of an inner wall thereof so as to space apart a first tunnel and a second tunnel smaller than the first tunnel; the first tunnel is served to insert through the cold-water inlet pipe, the hot-water inlet pipe, and the mixing outlet pipe; the second tunnel is used for inserting through the hose.

4. The fixing structure of the faucet as claimed in claim 1, wherein the groove of the sheath has a trench defined on an inner wall thereof and extending to a bottom rim of the sheath; the annular fence of the base has a fixing protrusion formed around the outer wall thereof and retained in the trench, such that the sheath and the base are positioned quickly by ways of the threaded orifice and the retaining recess.

5. The fixing structure of the faucet as claimed in claim 1, wherein the faucet further includes a threaded screwed with a bottom end of the fitting tube so that the sheath is clamped between the fitting tube and the threaded sleeve.

6. The fixing structure of the faucet as claimed in claim 5, wherein the fitting tube further has a peripheral bottom fringe defined therearound and at least one limiting blocks extending outwardly from the peripheral bottom fringe; the groove of the sheath has a peripheral rib arranged adjacent to an upper side of the inner wall thereof and clamped between the peripheral bottom fringe of the fitting tube and the threaded sleeve, and the peripheral rib has at least one defining notches formed thereon so as to retain with the two limiting blocks, hence the fitting tube is limited to rotate relative to the sheath.

7. The fixing structure of the faucet as claimed in claim 1, wherein the groove of the sheath has an annularly raised flange extending outwardly from the inner wall thereof, and the annularly raised flange has at least two cutouts for defining at least one first vertical slot and at least one second vertical slot; the groove of the sheath further has at least one engaging indention defined on a top rim thereof; the fitting tube has a stepped fence formed on an outer wall thereof adjacent to a bottom end of the fitting tube so as to contact with a top wall of the annularly raised flange of the sheath, and the stepped fence has at least one sliding member formed on an outer wall of a lower side thereof and at least one resilient member; the at least one sliding member is slid into the at least one first vertical slot of the sheath, and the at least one resilient member is slid into the at least one second vertical slot of the sheath; when the fitting tube is rotated toward a predetermined direction, the at least one sliding member engages with a bottom wall of the annularly raised flange of the sheath so as to limit the fitting tube to remove upwardly, and the at least one resilient member slides into and retains with the at least one engaging indention, thus limiting the fitting tube rotation circumferentially.

8. The fixing structure of the faucet as claimed in claim 7, wherein each of the at least one resilient member has an elastic wing portion and a pillar extending outwardly from an outer wall of the elastic wing portion so as to be fixed in each of the at least one engaging indention.

9. The fixing structure of the faucet as claimed in claim 7, wherein the at least one sliding member has a longitudinal cliff formed thereon and retaining with one of the at least one first vertical slot as the fitting tube rotates toward a predetermined direction, such that each resilient member engages with each engaging indention.

10. The fixing structure of the faucet as claimed in claim 7, wherein the sheath has two symmetrical first vertical slots, two symmetrical second vertical slots, and two engaging indentions; the fitting tube has two sliding members and two resilient members; the at least one sliding member has a longitudinal cliff formed thereon and retaining with one of the at least one first vertical slot as the fitting tube rotates toward a predetermined direction, such that each resilient member engages with each engaging indention.

11. The fixing structure of the faucet as claimed in claim 1, wherein each positioning screw has a bottom end for screwing a positioning sleeve, such that each clamping block is stopped moving downwardly and removing from each positioning screw.

12. The fixing structure of the faucet as claimed in claim 1, wherein the faucet also comprises a hammer disposed on the hose.

13. The fixing structure of the faucet as claimed in claim 1, wherein the retaining recess of the base has a tilted bottom face, and when screwing the fastening bolt, a distal end of the fastening bolt abuts against the tilted bottom face so that the base and the sheath produce a longitudinal force which moves the sheath downwardly.

14. The fixing structure of the faucet as claimed in claim 1, wherein the annular fence of the base also has a biasing portion formed thereon; the groove has a receiving portion defined on the inner wall thereof and forced by the biasing portion; at least one of the biasing portion and the receiving portion has a conical face so that when the fastening bolt abuts against the tilted bottom face, the sheath is forced to move downwardly by the longitudinal force.

15. The fixing structure of the faucet as claimed in claim 14, wherein the annular fence of the base further has a circular flange arranged on the biasing portion and a biasing portion formed thereon; the groove of the sheath also has a circular trough formed on the inner wall thereof, and the circular trough has a circular lip arranged thereon, wherein the receiving portion is comprised of the circular lip; the biasing portion has a conical face, and the receiving portion has an arcuate guiding face.

16. The fixing structure of the faucet as claimed in claim 2, wherein the faucet further includes a cap fitted on the top end of the fitting tube, the housing is limited between the cap and the sheath.

* * * * *